US005129876A

United States Patent [19]

Brabant et al.

[11] Patent Number: 5,129,876

[45] Date of Patent: Jul. 14, 1992

[54] FOLD ROLLER

[75] Inventors: Yvan E. Brabant, Boca Raton; Tom Galvanauskas, Palm Bay, both of Fla.

[73] Assignee: Profold, Inc., Sebastian, Fla.

[21] Appl. No.: 664,316

[22] Filed: Mar. 1, 1991

[51] Int. Cl.[5] ..... B65H 45/16; B65H 45/14

[52] U.S. Cl. ..... 493/471; 493/442; 493/454; 493/419; 29/121.1; 29/121.5; 29/121.6; 29/132

[58] Field of Search ..... 493/419-421, 493/442, 454, 471; 29/121.1, 121.2-121.6, 121.8, 132

[56] References Cited

U.S. PATENT DOCUMENTS 3,339,818 9/1967 Morrow ..... 29/121.2
4,353,296 10/1982 Beucker ..... 29/121.6
4,375,971 3/1983 Moll ..... 493/420

FOREIGN PATENT DOCUMENTS 306190 6/1918 Fed. Rep. of Germany ..... 29/121.2
2302356 7/1974 Fed. Rep. of Germany ..... 493/454

*Primary Examiner*—Bruce M. Kisliuk
*Assistant Examiner*—Jack Lavinder
*Attorney, Agent, or Firm*—James B. Middleton

[57] ABSTRACT

A paper folding machine is improved by grooving the fold rollers. Grooves in the fold rollers extend along a curved path, from one end of the roller and terminating adjacent to the center of the roller. Complementary grooves extend from the opposite end of the roller towards the center of the roller. The surface of the roller is rubber or the like, and has a durometer hardness in the range of 65 to 72 Shore A. The grooves are shallow enough that the paper is not crimped or wrinkled by the grooves.

6 Claims, 1 Drawing Sheet

FOLD ROLLER

INFORMATION DISCLOSURE STATEMENT

Automatic paper folders are well known in the art, and exist in many different forms. Though folders in general work quite well and are commercially successful, folders are not always precise in their folds.

It is of course desirable in making a fold to provide a smooth fold, and a very sharp crease so the panels on each side of the crease lie substantially against each other. The prior art folders, however, do not provide the sharp creases desired, and sometimes yield very sloppy folds known as "box folds", wherein the fold is almost two creases with a short web between.

An improved folder is therefore needed to assure a smooth, sharp crease on each fold.

SUMMARY OF THE INVENTION

This invention relates generally to automatic paper folders, and is more particularly concerned with an improved fold roller for a paper folder.

The present invention provides a fold roller having a rubber surface, and a plurality of grooves defined in the rubber surface. The grooves extend generally longitudinally of the roller, but not parallel to the axis of the roller. The grooves are shallow grooves so that the paper is not deformed by sinking into the groove, but the grooves are just sufficient to drive the paper, and still provide a good creasing surface for the paper being folded.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENT

Figure 1:
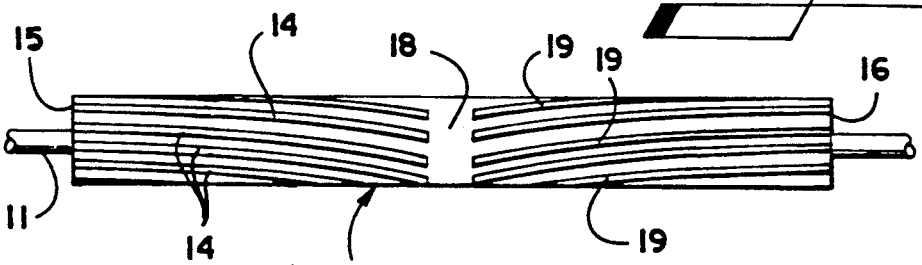
FIG. 1 is a front elevational view of an improved fold roller made in accordance with the present invention.

Referring now more particularly to the drawings, and to that embodiment of the invention here chosen by way of illustration, the roller shown in FIG. 1 of the drawings comprises a generally conventional fold roller having an axle 11 and a roller 12. As is conventional for fold rollers, the roller 12 is made up of a steel core covered with rubber or polyurethane, or other somewhat yieldable material. The roller 12 of the present invention, however, defines a plurality of grooves 14 therein.

In FIG. 1, the grooves 14 are seen to extend from the ends 15 and 16 of the roller 12, towards the center 18 of the roller. Preferably, as here shown, the grooves 14 terminate just before the center of the roller 12, leaving a smooth area at the center 18.

Figure 2:
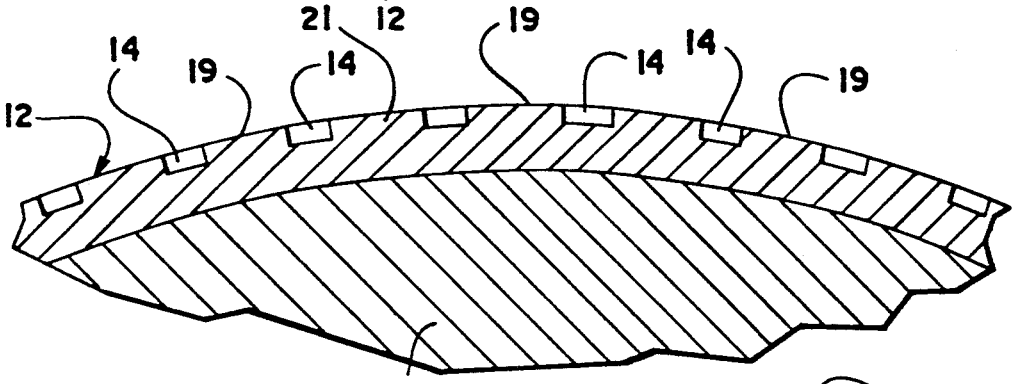
FIG. 2 is a highly enlarged, fragmentary, cross-sectional view taken transversely through the roller of FIG. 1.

Attention is next directed to FIG. 2 of the drawings for a better understanding of the nature of the grooves 14. In FIG. 2 it can be seen that the grooves 14 are quite shallow, and are spaced apart around the circumference of the roller 12. FIG. 2 also shows the steel core 20 covered by the rubber surface 21. As was stated previously, the surface 21 may be rubber, or polyurethane, or other rubber-like materials. Therefore, when the term "rubber" is used herein, it is intended that polyurethane and other equivalent materials are also included.

The hardness of the rubber surface 21 is important for proper operation of the present roller. If the covering 21 is very soft, there will be a wave behind the nip of the rollers, and this wave will tend to cause the paper to wrinkle, and also will cause one panel of the folded paper either to lead or to lag the other panel, resulting in a less than desirable fold. This mechanism will be discussed in more detail hereinafter.

Additionally, if the covering 21 is soft, the lands between the grooves 14 will not be stable and, again, will allow some shifting of the portion of the paper to be held by the roller. Thus, the hardness of the covering 21 is important. It has been found that the hardness should be in the range from 65 to 72 Shore A, the preferred hardness being about 70 Shore A.

By way of example, and not by way of limitation, one successful roller has been made wherein the roller 12 is 1½ inches in diameter, and there are twelve grooves spaced around the circumference of the roller, each groove having a depth (i.e., in the radial direction of the roller 12) of about 0.02 inch, or 0.5 mm, and a width (i.e., in the circumferential direction of the roller 12) of about 0.08 inch, or 2 mm. It will therefore be understood that the grooves 14 ought not to have a great depth to allow a portion of a sheet being folded to fall into the grooves and be crimped, or wrinkled.

The true reason for the greatly improved operation of the present invention is not understood by the inventor, but some theories have been created in an effort to explain the results. Thus, the following explanations are offered as an assistance in understanding how to make and use the invention without intending to allege that the invention truly works for the reasons given.

Looking again at FIG. 1 of the drawings, it will be noted that the grooves 14 are curved to be angularly off-set from parallelism with the axis of the roller 12, the result yielding an appearance similar to a herringbone pattern. The direction of operation of the roller is such that the roller 12 will drive the paper so that diverging grooves 14 will act on the paper, rather than converging grooves. As shown in FIG. 1, the surface viewed will move up. With the diverging grooves, or perhaps diverging lands 19, driving the sheet through the rollers, the sheet will be smoothed from the center outwardly. As a result, the sheet being folded will remain smooth and unwrinkled as it passes through the nip between the fold rolls.

Another consideration in folding a sheet is that both panels of the sheet must be driven together, and uniformly, to provide a sharp crease. If one panel is driven faster than the other, the crease may be somewhat rolled, creating a large radius, or perhaps a box fold, rather than a sharp, single-line crease. With this consideration in mind, it is thought that the grooves 14 of the present invention provide sharp edges at the sides of the grooves, the sharp edges acting to grip the sheet being folded and assure accurate, uniform, feeding of the sheet.

A further thought in folding sheets of paper is that there may well be air trapped within the fold. If a sheet is quickly folded, and the folded edge is run through the nip of a pair of rollers, the air may not be able to escape, and of course will somewhat balloon the fold to prevent a sharp crease. With this in mind, it will be understood that the fold roller of the present invention will engage the sheet firmly only with the lands 19, and the grooves 14 will provide areas that allow the movement of air. These areas, which is to say the grooves 14, will move outwardly as the roller 12 rotates, carrying the air out to the ends of the rolls, and to the edges of the sheet of paper, where the air will be released. As a result, entrapped air will not balloon the crease; rather, the air will be released and the crease can be sharp.

Figure 3:
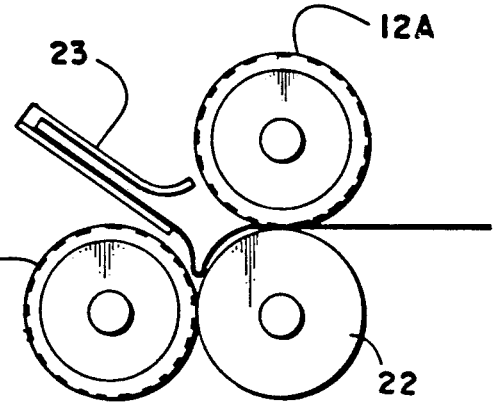
FIG. 3 is a side elevational view showing three rolls and one fold plate, and showing a piece of paper entering the nip between the fold rollers.

FIG. 3 of the drawings illustrates the conventional use of fold rolls, and illustrates fold rolls made in accordance with the present invention. It will be seen that there is a first roll 22 substantially engaging a fold roll 12A. As here shown, the first roll 22 may be a conventional steel roll. Those skilled in the art will understand that steel rolls are used in paper folders, the surface of the steel rolls being knurled to asure a grip on the paper being folded. The steel roll is included here to show that the grooved rolls of the present invention may be used in conjunction with any other roll, whether steel rolls, or other grooved rolls made in accordance with the present invention.

A sheet of paper to be folded passes between the rolls 22 and 12A, and enters the fold plate 23. When the end of the sheet engages the paper stop, the sheet will buckle, and the resulting fold will move towards the nip between the first roll 22 and the fold roll 12B. The sheet of paper passes between the rolls 22 and 12B, and the paper is creased.

Those skilled in the art will realize that the first roll 22 and the fold roll 12A are usually spring-urged together to allow a sheet of paper to enter the nip. The rolls 22 and 12B are usually rigidly, though adjustably, mounted, and these rolls will be slightly spaced apart to allow paper to pass through the nip. The distance between the fold rolls is typically around 0.0005 inch, and is variable for different thicknesses of paper.

Figure 4:
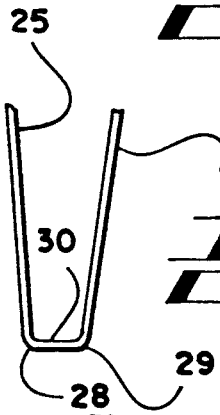
Fig 4 PRIOR ART
FIG. 4 is a rather schematic illustration showing a piece of paper exhibiting a box fold.

Attention is next directed to FIG. 4 of the drawings which illustrates a box fold. The illustration is exaggerated in order to show the problem clearly, but it can be seen that the panels 25 and 26 of the paper are spaced apart, and the fold includes two creases 28 and 29 joined by a web 30. Obviously this is not a neat crease, and the panels 25 and 26 will not lie against each other.

Figure 5:
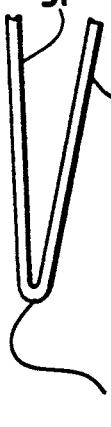
Fig 5 PRIOR ART
FIG. 5 is a rather schematic illustration showing a piece of paper folded by a prior art folder; and, FIG. 6 is a rather schematic illustration showing a piece of paper folded using the fold rollers of the present invention.

FIG. 5 is intended to illustrate the common "successful" fold from a prior art folder. The panels 31 and 32 are close to each other, but are joined by a small radius 34. As a result, the panels 31 and 32 will still be separated somewhat at the fold.

Figure 6:
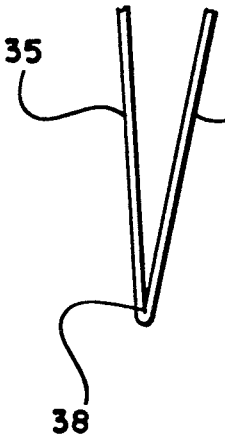

FIG. 6 illustrates a fold as made by the fold roller of the present invention. It will here be seen that the panels 35 and 36 merge in a sharp V 38. As a result, when the panels 35 and 36 are urged together, the V-fold will not hold the panels apart. This is an ideal, and perfection is not achieved; however, the fold made by a fold roller of the present invention is substantially flatter than a fold made by the prior art fold roller. The result is that a stack of folded paper is of less height when the paper is folded using the fold roller of the present invention, and the creases are neater than with the prior art fold rollers.

It will of course be understood by those skilled in the art that the particular embodiment of the invention here presented is by way of illustration only, and is meant to be in no way restrictive; therefore, numerous changes and modifications may be made, and the full use of equivalents resorted to, without departing from the spirit of scope of the invention as outlined in the appended claims.

We claim:

1. In a paper folding apparatus, comprising a pair of fold rolls adjacent to each other and including a nip therebetween, said fold rolls being parallel to each other, each roll of said pair of rolls having a gripping surface for gripping paper being folded, the improvement wherein at least one roll of said pair of rolls includes a rubber surface defining a plurality of grooves in the surface thereof, said rubber surface having a hardness of at least 65 Shore A, said at least one roll having an axis, two ends, and a center between said two ends, said plurality of grooves further comprising a first plurality of grooves extending form one end of said two ends towards said center, and a second plurality of grooves extending from the other end of said two ends towards said center without intersecting the first plurality of grooves, said first plurality of grooves and said second plurality of grooves deviating from parallelism with said axis as the grooves extend toward the center of the roll, each groove of said first and said second plurality of grooves having a depth that is insufficient to receive a sheet of paper and cause wrinkling of the sheet of paper.

2. In a paper folding apparatus as claimed in claim 1, the further improvement wherein said plurality of grooves are substantially uniformly distributed around the circumference of said at least one roll.

3. In a folding apparatus as claimed in claim 2, the improvement wherein said rubber surface has a hardness in the range of 65 to 72 Shore A.

4. In a folding apparatus as claimed in claim 3, said plurality of grooves having a depth of approximately 0.02 inch.

5. In a folding apparatus as claimed in claim 4, said plurality of grooves having a width of approximately 0.08 inch.

6. In a folding apparatus as claimed in claim 5, the improvement wherein said rubber surface has a hardness of about 70 Shore A.

* * * * *